US007220153B2

(12) United States Patent
Okuyama

(10) Patent No.: US 7,220,153 B2
(45) Date of Patent: May 22, 2007

(54) CONTROL DEVICE FOR OUTBOARD MOTORS

(75) Inventor: Takashi Okuyama, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 125 days.

(21) Appl. No.: 11/182,678

(22) Filed: Jul. 15, 2005

(65) Prior Publication Data

US 2006/0014447 A1 Jan. 19, 2006

(30) Foreign Application Priority Data

Jul. 15, 2004 (JP) ..... 2004-208452

(51) Int. Cl.
*B63H 21/22* (2006.01)
*B60W 10/04* (2006.01)

(52) U.S. Cl. ..... 440/1; 440/84

(58) Field of Classification Search ..... None
See application file for complete search history.

(56) References Cited

U.S. PATENT DOCUMENTS 4,850,906 A * 7/1989 Kanno ..... 440/2
5,782,659 A * 7/1998 Motose ..... 440/1
6,382,122 B1 * 5/2002 Gaynor et al. ..... 114/144 RE

OTHER PUBLICATIONS

Product catalog of i6000TEC—Triple Engine Electronic Shift & Throttle of Teleflex Morse Co., Ltd. (USA).

* cited by examiner

*Primary Examiner*—Jesus Sotelo
*Assistant Examiner*—Daniel V. Venne
(74) *Attorney, Agent, or Firm*—Knobbe, Martens, Olson & Bear, LLP

(57) ABSTRACT

A control method can be provided for a watercraft that has three or more outboard motors mounted thereon side by side with each other. Two control levers which are primarily provided for shift and throttle controls of respective two of the outboard motors located on the outer-most sides make shift and throttle controls of all the outboard motors. A control range of the respective control levers includes a forward range, a reverse range and a neutral range between the forward and reverse ranges. The method can include, when both of the control levers are placed at a preset position in the respective neutral ranges, setting a shift position of an outboard motor located between the outer-most sides at a forward position or a reverse position, and setting a throttle opening of the outboard motor at a preset opening.

6 Claims, 9 Drawing Sheets

| Left lever position | Right lever position | Left engine | Center engine | Right engine |
|---|---|---|---|---|
| N - F side middle point | N - F side middle point | N | N | N |
| N - F side middle point | F-side middle point - F-shift-in fully closed | N | N | N |
| F-side middle point - F-shift-in fully closed | N - F side middle point | N | N | N |
| F-side middle point - F-shift-in fully closed | F-side middle point - F-shift-in fully closed | N | F-shift-in fully closed | N |

*Figure 5*

| Left lever position | Right lever position | Left engine | Center engine | Right engine |
|---|---|---|---|---|
| N - R side middle point | N - R side middle point | N | N | N |
| N - R side middle point | R-side middle point - R-shift-in fully closed | N | N | N |
| R-side middle point - R-shift-in fully closed | N - R side middle point | N | N | N |
| R-side middle point - R-shift-in fully closed | R-side middle point - R-shift-in fully closed | N | R-shift-in fully closed | N |

*Figure 8*

CONTROL DEVICE FOR OUTBOARD MOTORS

PRIORITY INFORMATION

This application is based on and claims priority under 35 U.S.C. §119 to Japanese Patent Application No. 2004-208452, filed on Jul. 15, 2004, the entire contents of which is hereby expressly incorporated by reference herein.

BACKGROUND OF THE INVENTIONS

1. Field of the Inventions

The present invention relates to a control device for outboard motors, and particularly relates to a control device for a watercraft that has three or more outboard motors mounted on a transom thereof side by side with each other.

2. Description of the Related Art

Some watercraft can have three outboard motors mounted on a transom thereof, in a side-by-side arrangement. Conventionally, such watercraft incorporate three sets of shift and throttle levers, each of which corresponds to a respective outboard motor. However, it can be a burden for the operator to operate six shift and throttle levers in addition to operating a steering device.

Recently, an improved control device for a watercraft that can control the entire shift and throttle operations of three outboard motors with two levers disposed transversely next to each other (see Non-patent Literature 1) has been suggested. For example, the i6000 series, shift/throttle lever for three outboard motors, available from the Teleflex Morse Co., Ltd. (USA) is such a device.

Using such a device, the operator can control operations of the outboard motor located on the right hand side (hereinafter called "starboard side outboard motor") using the lever positioned on the starboard side, while the operator controls operations of the outboard motor located on the left hand side (hereinafter called "port side outboard motor") using the lever positioned on the port side. The outboard motor centrally located between the starboard side outboard motor and the port side outboard motor is controlled in accordance with operational conditions of the starboard side outboard motor and the port side outboard motor. That is, if the starboard side outboard motor or the port side outboard motor is controlled to be in a forward mode and the other one of those motors is controlled to be in a reverse mode, the center outboard motor is controlled to be in a neutral mode. If both of the motors are controlled to be in the same mode, the center outboard motor is also controlled to be in the same mode and in the same throttle opening as those of the starboard side outboard motor or the port side outboard motor.

In some cases, during actual control of a watercraft, such as a trolling control, the throttle levers may need to move to a position corresponding to a fully closed position of a throttle valve so that the watercraft can move very slowly at an extremely low engine speed. Under such circumstances, however, such a low speed cannot be obtained, because the total propulsive force of two or three of the outboard motors, while running at their lowest engine speed, is too strong to allow the watercraft to move at the desired speed. For example, even if the operator sets one of the starboard side or port side outboard motors in the neutral mode to eliminate any propulsive force from that motor, so that the watercraft moves with a thrust that is generated by a single outboard motor, the other one of the starboard side or port side outboard motors and the center outboard motor will continuously generate thrust. Thus, the watercraft is not able to move at the extremely low speed that the operator desires to obtain.

SUMMARY OF THE INVENTIONS

An aspect of at least one of the embodiments disclosed herein includes the realization that a control system for an outboard motor powered watercraft can be configured to provide enhanced speed control where the control system is configured to recognize additional intermediate positions of a thrust control lever, and to change the number of motors that provide thrust based on the position of the control lever.

Thus, in accordance with an embodiment, a control method for a watercraft that has three or more outboard motors mounted thereon in a side-by-side arrangement, at least two control levers configured to allow an operator to control gear shift and power output adjustments of two of the outboard motors located on the outer-most sides and configured to also control gear shift and power output adjustments of all the outboard motors, wherein each of the control levers include a forward range, a reverse range, and a neutral range between the forward and reverse ranges is provided. The method can comprise setting a shift position of an outboard motor located between the outer-most outboard motors at a forward position or a reverse position, and setting a throttle opening of the outboard motor located between the outer-most outboard motors at a preset opening when both of the control levers are placed at a preset position in the respective neutral ranges.

In accordance with another embodiment, a control device for a watercraft that has three or more outboard motors mounted on a transom thereof side by side with each other, can comprise a controller including two control levers configured to allow an operator to input gear shift and engine power output commands to two of the outboard motors, respectively, located on the outer-most sides of the watercraft. A detection device can be configured to detect respective control positions of the two levers. The control device can comprise a control circuit configured to compute gear shift positions and power output settings of all the outboard motors based upon the respective control positions of the two levers. The control circuit can include a computing section configured to change the gear position of one of the outboard motors interposed between the two outer-most outboard motors to a forward position or a reverse position and to change a power output setting of said one of the outboard motors to a minimum power output setting, when both detected positions of the two levers are consistent with preset positions within their respective neutral ranges.

In accordance with yet another embodiment, a control system for a watercraft having at least first, second, and third outboard motors, the third outboard motor being disposed between the first and second outboard motors can comprise at least first and second input devices configured to allow an operator of the watercraft to input gear change commands corresponding to gear positions of the outboard motors and power output commands corresponding to power outputs of the outboard motors. The first and second input devices can include neutral ranges corresponding to neutral gear positions of the first and second outboard motors. The control system can be configured to maintain the gear positions of the first and second outboard motors in the neutral position and to change the gear position of the third outboard motor to a forward or reverse gear position when the first and second levers are moved within the neutral ranges toward boundaries between the neutral ranges and forward or reverse gear position ranges.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures:

FIG. 5 is a table showing exemplary but non-limiting relationships between lever positions and engine operations in connection with the control device.

FIG. 8 is a table showing exemplary relationships between lever positions and engine operations in connection with the control device.

DETAILED DESCRIPTION OF THE PREFERRED EMBODIMENT

Figure 1:
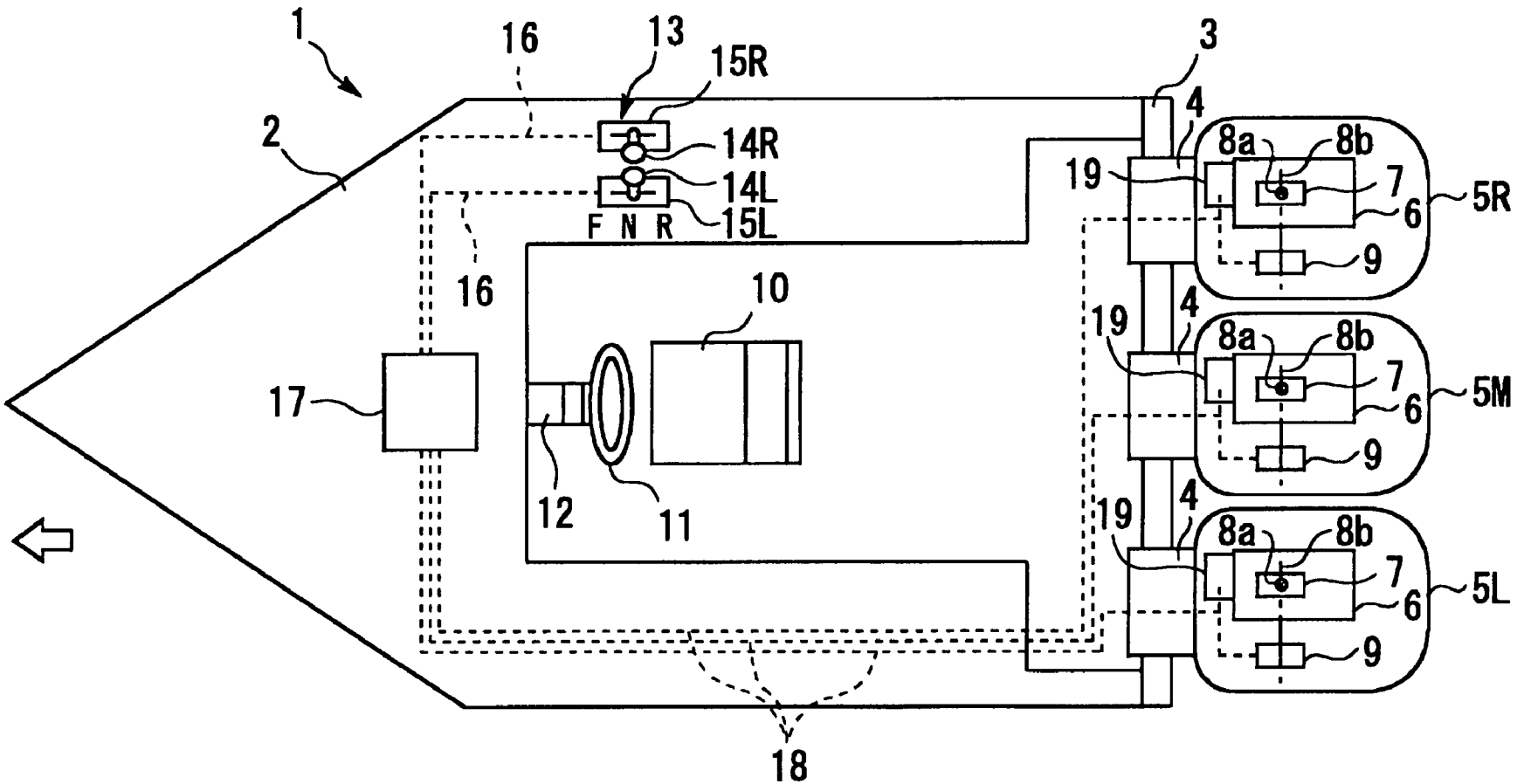
FIG. 1 is a schematic top plan view of a watercraft that incorporates a control device configured in accordance with an embodiment.

FIG. 1 is a schematic top plan view of a small boat including a control device configured to operate three outboard motors. The embodiments disclosed herein are described in the context of a marine propulsion system of a small boat because these embodiments have particular utility in this context. However, the embodiments and inventions herein can also be applied to other marine vessels, such as personal watercraft and small jet boats, as well as other vehicles.

As shown in FIG. 1, the watercraft 1 can comprise a hull 2 and three or more outboard motors 5R, 5M, 5L mounted on a transom board 3 of the hull 2 through a clamping bracket 4. In this description, the outboard motor located on the right hand side relative to the watercraft advance direction that is indicated by the open arrow of FIG. 1 is called "the starboard side outboard motor 5R," the outboard motor located on the left hand side relative to the watercraft advance direction is called "the port side outboard motor 5L" and the outboard motor located between the starboard side outboard motor 5R and the port side outboard motor 5L is called "the middle outboard motor 5M."

The outboard motors 5R, 5M, 5L can each have an engine 6. An intake system of the engine 6 can have a throttle body 7 (or a carburetor) that adjusts an amount of intake air to the engine 6 to control an engine speed and torque of the engine 6. The throttle body 7 can have an electronically controlled throttle valve 8*a*.

A valve shaft 8*b* of the throttle valve 8*a* can be connected to an electric motor 9. The motor 9 can be electronically controlled to drive the throttle valve 8*a*. The throttle valve 8*a* thus moves between open and closed positions. A steering wheel 11 can be disposed in a forward area of an operator's seat 10 of the hull 2 for the operator to steer the watercraft 1. The steering wheel 11 can be attached to the hull 2 through a steering shaft 12.

A side of the hull 2 next to the operator's seat 10 can have a controller (remote controller) 13 for the operator to control operations of the respective outboard motors, although other positions can also be used. The controller 13 can have a right remote control lever 14R and a left remote control lever 14L both of which are disposed side by side with each other.

The right remote control lever 14R can be positioned on the right side of the left remote control lever 14L relative to the watercraft's forward direction. The controller 13 can also have potentiometers 15R, 15L for detecting the positions of the respective remote control levers 14R, 14L.

During operation, the operator of the watercraft 1 can operate the controller 13 to change shift modes of the respective outboard motors 5 and to adjust an opening of the throttle valve 8*a* of each engine 6 of the respective outboard motors 5. A thrust relating to a running speed, acceleration, deceleration and so forth of the watercraft 1 is thus controlled.

For example, the right remote control lever 14R can be configured to shift and adjust the opening of the throttle valve 8*a* (thrust change) of the starboard side outboard motor 5R, while the left remote control lever 14L can be configured to shift and adjust the opening of the throttle valve 8*a* (thrust change) of the port side outboard motor 5L.

These levers 14R, 14L each pivot about an axis at their respective bottom ends. A preset center position of the pivotal movement can be used to define a neutral range. Optionally, the controller 13 can include a detent mechanism or other device configured to give the operator a tactile response when the associated lever reaches such a predetermined position, including the predetermined positions noted below. If the levers 14R, 14L are each positioned in the neutral range, the associated outboard motor is in a neutral mode or neutral position (N).

A preset forward position located forward from the center position can be configured to define a forward movement range. If the levers 14R, 14L are each positioned in the forward range, the associated outboard motor is in a forward mode or forward position (F).

A preset rear position located rearwardly from the center position can be configured to define a reverse range. If the levers 14R, 14L are each positioned in the reverse range, the associated outboard motor is in a reverse mode or reverse position (R).

The throttle valve 8*a* can be controlled to gradually move to an F fully open position from an F fully closed position when the shift lever 14R, 14L is gradually moved forward within the forward range (F). The throttle valve 8*a* can be controlled to gradually move to an R fully open position from an R fully closed position when the shift levers 14R, 14L are each gradually moved rearward within the reverse range (R). Thus, the operator can operate the respective throttle valves 8*a* between the open and closed positions to adjust the output of the respective engines 6 (thrust control) while the watercraft moves forward or backward.

The controller 13 can be connected to a control circuit 17 through signal cables 16. The control circuit 17 can be connected so as to receive signals including lever position information of the respective remote control levers 14R, 14L from the potentiometers 15R, 15L. The control circuit 17 can be configured to make a preset computation and to output drive signals to the respective three outboard motors 5.

Signal cables 18 can be used to connect the respective outboard motors 5 and the control circuit 17 with each other. Each outboard motor can incorporate an electrically powered shift mechanism 19, which can be provided to the outboard motor 5 together with the engine 6. The shift mechanism 19 can be configured to change the shift modes of the associated outboard motor 5 so that the watercraft moves forward or backward.

Additionally, other than those devices, the hull 2 can have a steering drive device (not shown) that rotates each outboard motor about a swivel axis (not shown) in accordance with an operational angle of the steering wheel 11.

Figure 2:
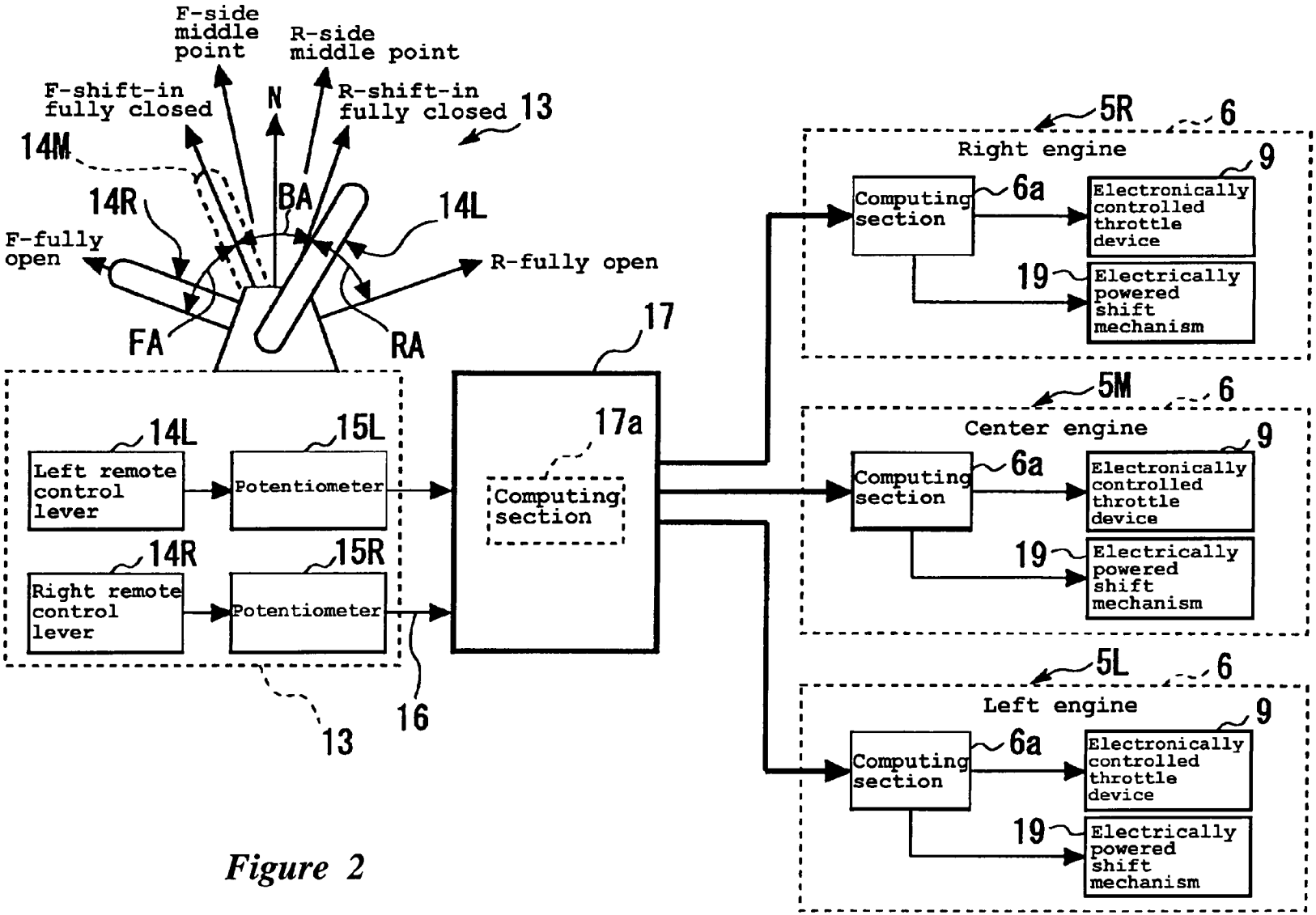
FIG. 2 is a block diagram of the control device that can serve as the control device incorporated into the watercraft of FIG. 1.

FIG. 2 is a block diagram of a control device configured in accordance with an embodiment. The control device can comprises the controller 13, the control circuit 17 and the respective outboard motors 5R, 5M, 5L, as well as other devices.

With reference to FIG. 2, a lever position of the right remote control lever 14R of the controller 13 can be detected by the associated potentiometer 15R. A signal including the lever position information can be input to a computing section 17*a* of the control circuit 17. Similarly, a lever position of the left remote control lever 14L of the controller 13 can be detected by the associated potentiometer 15L. A signal including the lever position information can be input to a computing section 17*a* of the control circuit 17.

The computing section 17*a* can be configured to compute a drive command based upon the position information of the right remote control lever 14R input thereto and to output a drive signal including the drive command to the electronically controlled throttle device (i.e., the motor 9) and the electrically powered shift mechanism 19 of the starboard side outboard motor 5R. The computing section 17*a* can also be configured to compute a drive command based upon the position information of the left remote control lever 14L input thereto and to output a drive signal including the drive command to the electronically controlled throttle device (i.e., the motor 9) and the electrically powered shift mechanism 19 of the port side outboard motor 5L.

Further, the computing section 17*a* can be configured to compute a target shift position and a target thrust power amount of the middle outboard motor 5M based upon the position information of the right remote control lever 14R and the position information of the left remote control lever 14L in accordance with a rule which is described below. Additionally, the computing section 17*a* can be configured to output a drive signal of a target value to the electronically controlled throttle device (i.e., the motor 9) and the electrically powered shift mechanism 19 of the middle outboard motor 5M from the control circuit 17.

Each engine 6 of the respective outboard motors 5 can have a computing section 6*a* configured to convert the output signal from the control circuit 17 to the target drive signals of the electronically controlled throttle device 9 and the electrically powered shift mechanism 19. Alternatively, each computing section 6*a* can be configured to compute the sift position and the thrust power amount of the respective outboard motors. In this alternative, the control circuit 17, which belongs to the controller, sends only the position information of the respective remote control levers to the computing sections 6*a* of the respective engines. An exemplary engine control of the respective outboard motors 5R, 5M, 5L is described below.

As shown in FIG. 2, each movable range of the respective remote control levers 14R, 14L of the controller 13 comprises a forward throttle control range FA, a reverse throttle control range RA and a neutral range BA interposed between the ranges FA, RA.

The forward throttle control range FA is the range of FIG. 2 positioned between a forward throttle fully closed position (forward shift-in operation start position) indicated by the term "F shift-in fully closed" and a forward throttle fully open position indicated by the term "F fully open." The reverse throttle control range RA is the range between a reverse throttle fully closed position (reverse shift-in operation start position) indicated by the term "R shift-in fully closed" and a reverse throttle fully open position indicated by the term "R fully open." The neutral range BA is the range between the forward throttle fully closed position and the reverse throttle fully closed position. The shift mode is neutral is this neutral range BA. The reference symbol "N" indicates the center position of the neutral range.

In this embodiment, normally, the control circuit 17 reads both lever positions of the right and left remote control levers 14R, 14L. The control circuit 17 outputs a drive signal corresponding to the remote control lever 14R to the engine 6 of the starboard side outboard motor 5R, while the control circuit 17 outputs a drive signal corresponding to the remote control lever 14L to the engine 6 of the port side outboard motor 5L.

Also, in connection with the engine 6 of the middle outboard motor 5M, the computing section 17*a* of the control circuit 17 can be configured to compute a middle point between the two lever positions. Assuming that a central remote control lever (hypothetical lever) 14M is positioned in the middle point, the computing section 17*a* outputs a drive signal corresponding to the middle point that has been computed to the computing section 6*a* of the engine 6 of the middle outboard motor 5M.

Also, in this embodiment, another control method described below, can be applied to the middle outboard motor 5M when both of the remote control levers 14R, 14L are positioned in a preset range within the neutral range BA.

Figure 3:
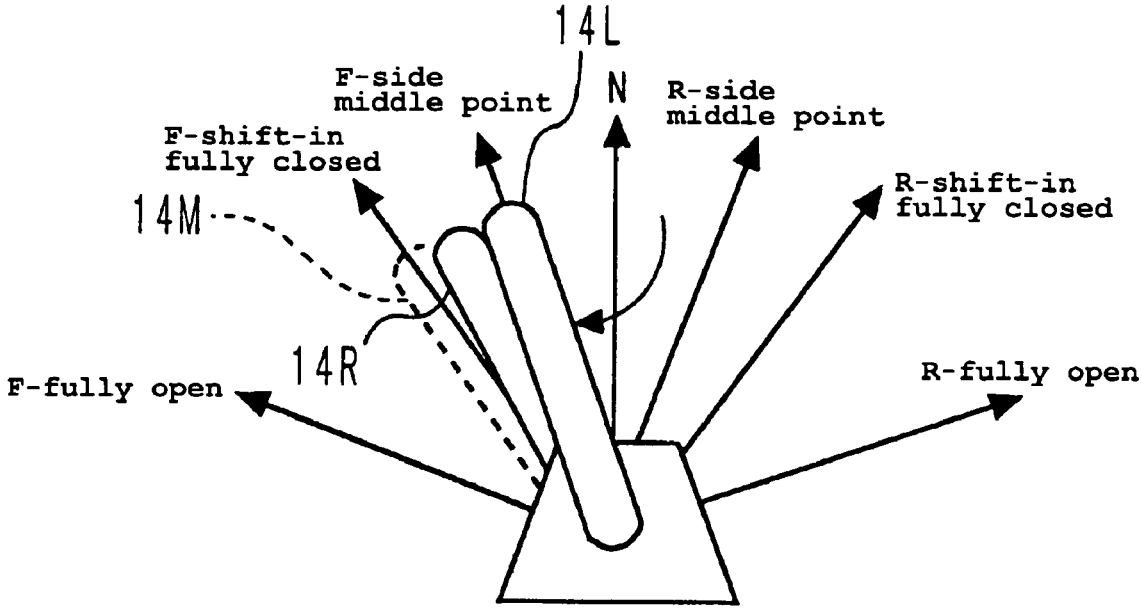
FIG. 3 is a schematic side elevational view of a controller that can be used with the control device of FIGS. 1 and 2.
Figure 4:
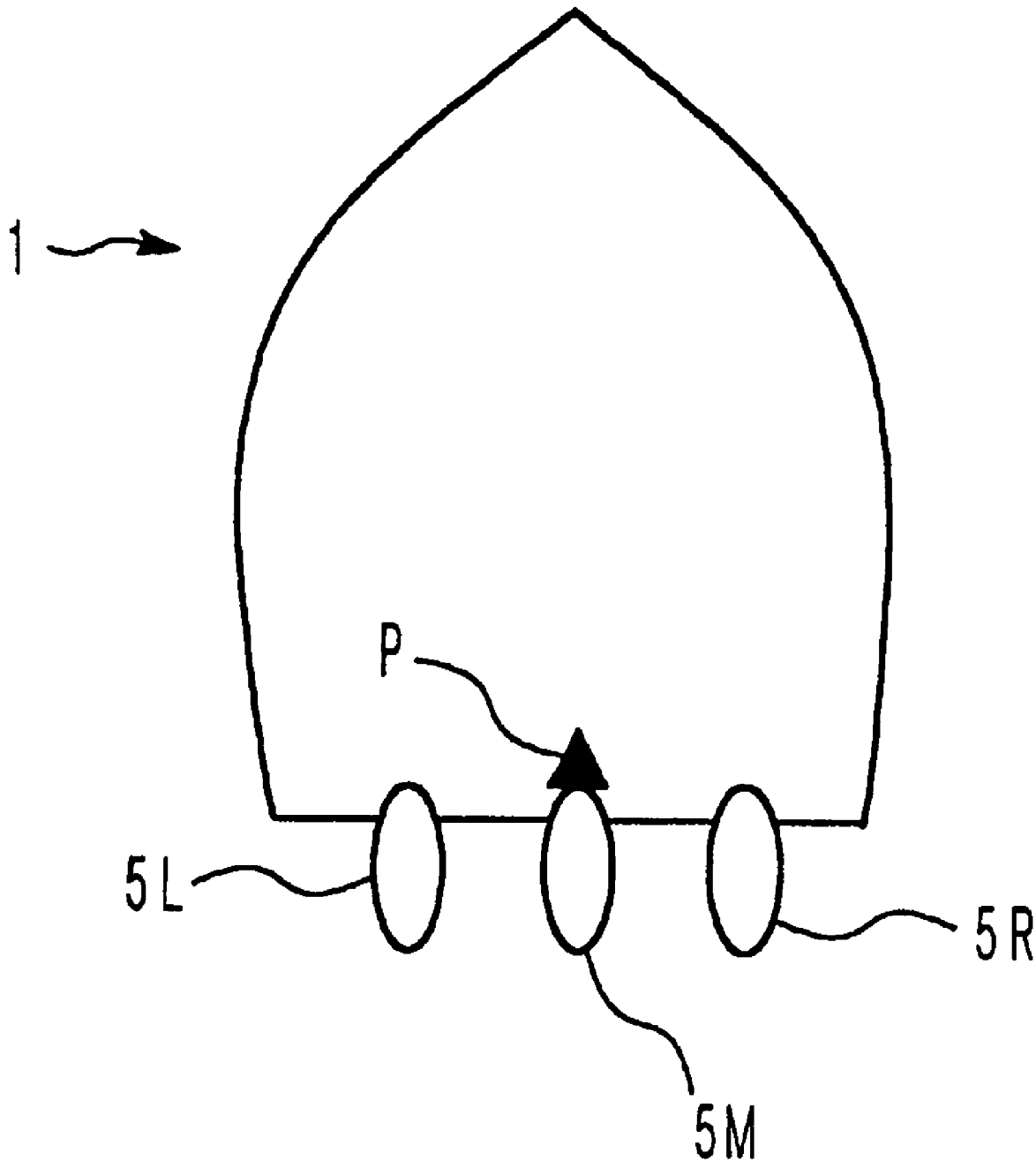
FIG. 4 is a schematic top plan view of the watercraft illustrating an exemplary but non-limiting operation thereof.

FIGS. 3 and 4 are illustrations showing an exemplary but non-limiting operation under which the watercraft 1 moves forward at an extremely low speed. FIG. 3 shows a lever position for obtaining the extremely low speed. FIG. 4 shows the watercraft 1 having three outboard motors that are controlled by the controller 13 incorporating the right and left remote control levers 14R, 14L. The lever indicated by the dotted line of FIG. 3 is the hypothetical remote control lever 14M placed at a position assumed by the positions of the right and left remote controllers 14R, 14L to control the middle outboard motor 5M.

In the illustrated embodiment, a center position between the neutral center position N and the forward throttle (F) fully closed position is decided to be an "F side middle point." The forward throttle (F) fully closed position is a position at which the throttle opening is the minimum immediately after the shift lever is moved to the forward range from the neutral range, and corresponds to the forward shift-in operation start position in the claims. Also, a center position between the neutral center position N and the reverse throttle (R) fully closed position is decided to be an "R side middle point." The reverse throttle (R) fully closed position is a position at which the throttle opening is the minimum immediately after the shift lever is moved to the reverse range from the neutral range, and corresponds to the reverse shift-in operation start position.

In this regard, if the right and left remote control levers 14R, 14L are together positioned in the range interposed between the "F side middle point" and the forward throttle fully closed position, the computing section 17*a* outputs drive signals to the respective engines 6 of the starboard side outboard motor 5R and the port side outboard motor 5L so that each shift mechanism 19 is set to the neutral position in accordance with the lever positions of the remote control levers 14R, 14L. In connection with the engine 6 of the middle outboard motor 5M, the computing section 17*a* does not seek for a middle position of the respective levers in the way described above. The computing section 17*a*, rather, assumes that the hypothetical central remote control lever 14M is placed at the forward throttle (F) fully closed position, and outputs a drive signal corresponding to the forward throttle (F) fully closed position to the computing section 6*a* of the engine 6 of the middle outboard motor 5M. As used herein, the references to the hypothetical central remote control lever 14M are used merely to help the reader understand the determinations made by the computing section 17. The computing section 17 does not have to be configured to make determinations related to a hypothetical lever. Rather, the computing section 17 can be configured to merely make calculations, for example but without limitation, comparisons, averages, etc., to make the determinations noted herein.

As a result, as shown in FIG. 4, both shift mechanisms 19 of the starboard side outboard motor 5R and the port side outboard motor 5L are set to the neutral position. Thus, the outboard motors 5R 5L are controlled so as to stop producing thrust for moving the watercraft 1. In this scenario, only the middle outboard motor 5M operates at the forward throttle (F) fully closed position to provide the thrust, which is indicated by the arrow p in the figure, to the watercraft 1. Accordingly, the watercraft 1 can move forward at the extremely low speed. Additionally, as shown in FIG. 5, in connection with the range between the neutral center position N and the forward throttle (F) fully closed position, all the combinations of lever positions result in the neutral drive of all the engines 6 of the starboard side outboard motor 5R, the port side outboard motor 5L and the middle outboard motor 5M, except for the combination that brings in the extremely low speed movement. Under those conditions, the watercraft 1 is at a standstill.

Figure 6:
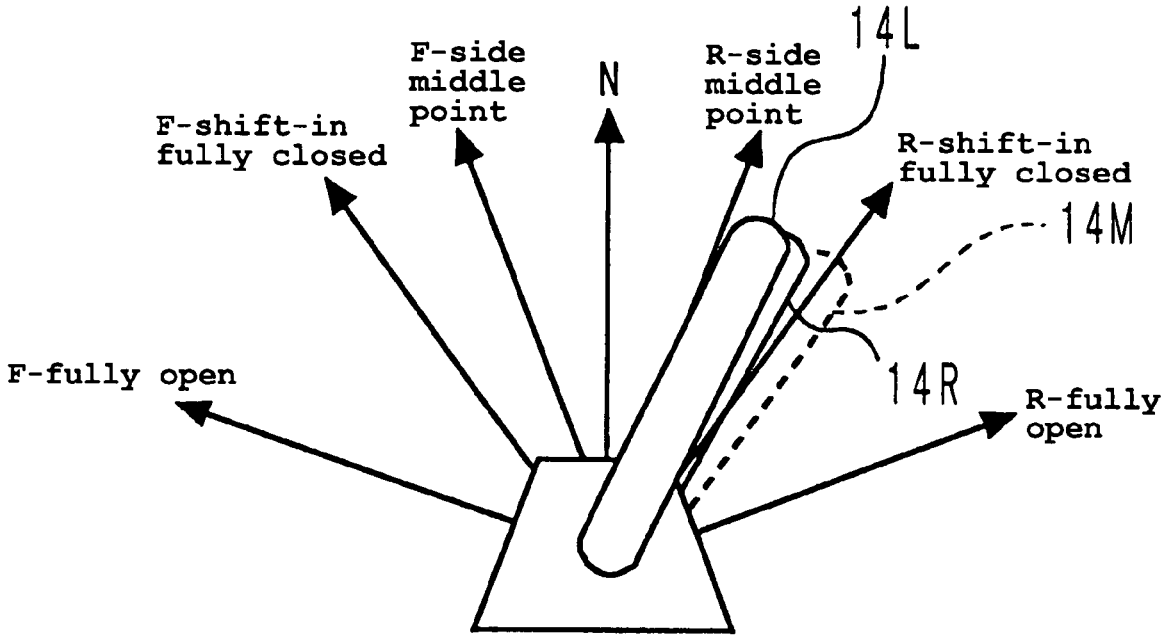
FIG. 6 is a schematic side elevational view of a controller that can be used with the control device.
Figure 7:
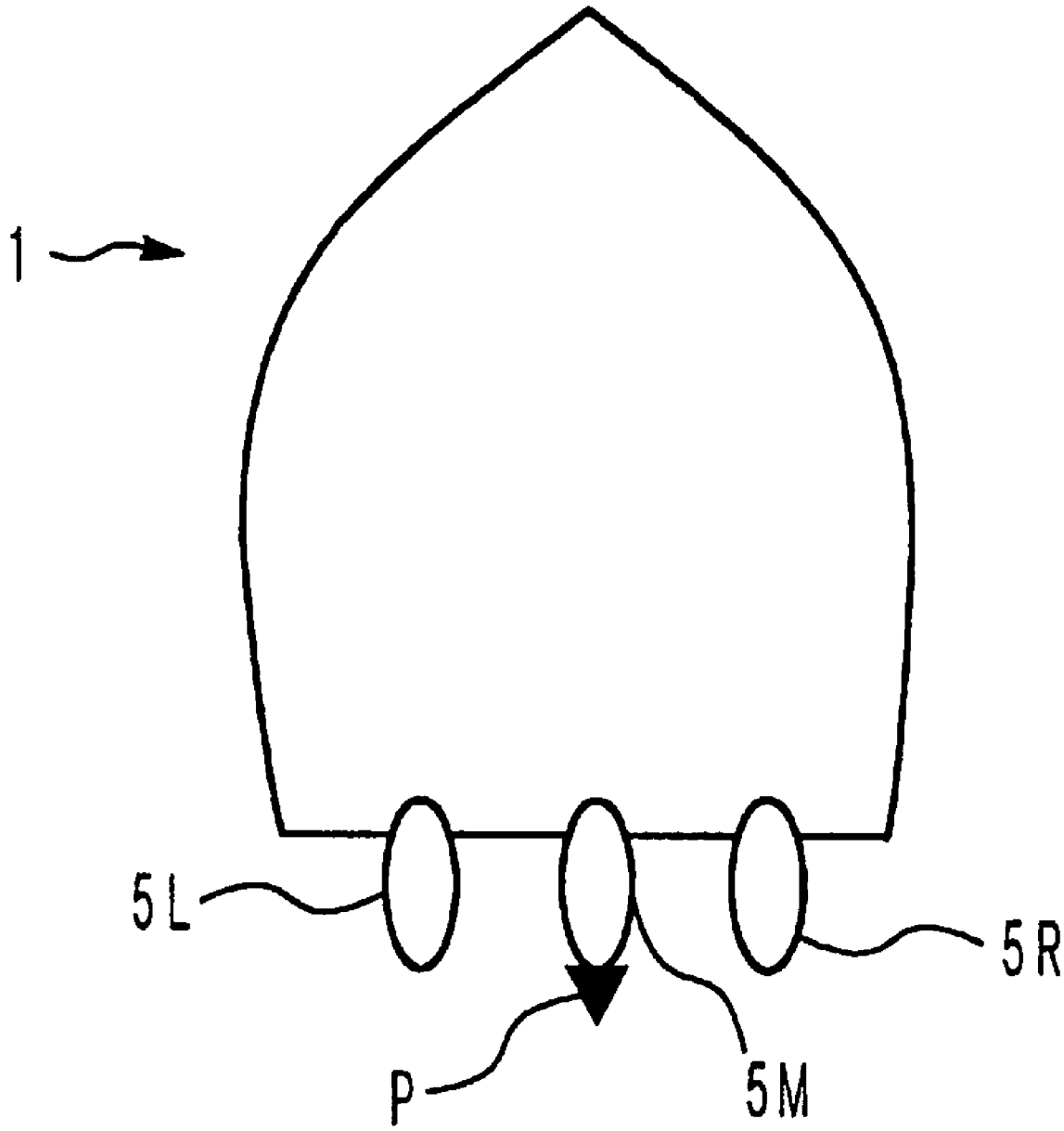
FIG. 7 is a schematic top plan view of the watercraft illustrating an exemplary but non-limiting operation thereof.

FIGS. 6 and 7 are illustrations explaining a control method under which the watercraft 1 moves backward at an extremely low speed. FIG. 6 shows a lever position for obtaining an extremely low speed. FIG. 7 shows the watercraft 1 having three outboard motors that are controlled by the controller 13 incorporating the right and left remote control levers 14R, 14L.

In some embodiments, if the right and left remote control levers 14R, 14L are together positioned in the range interposed between the "R side middle point" and the reverse throttle fully closed position, the computing section 17*a* outputs drive signals to the respective engines 6 of the starboard side outboard motor 5R and the port side outboard motor 5L so that each shift mechanism 19 is set to the neutral position in accordance with the lever positions of the remote control levers 14R, 14L. On the other hand, in connection with the engine 6 of the middle outboard motor 5M, the computing section 17*a* operates as if the hypothetical central remote control lever 14M is placed at the reverse throttle (R) fully closed position, and outputs a drive signal corresponding to the reverse throttle (R) fully closed position to the computing section 6*a* of the engine 6 of the middle outboard motor 5M.

As a result, as shown in FIG. 7, both shift mechanisms 19 of the starboard side outboard motor 5R and the port side outboard motor 5L are set to the neutral position. Thus, both outboard motors 5R 5L are controlled so as to stop producing thrust for moving the watercraft 1. However, the middle outboard motor 5M continues to operate at the reverse throttle (R) fully closed position to provide the thrust, which is indicated by the arrow p in the figure, to the watercraft 1. Accordingly, the watercraft 1 can move backward at the extremely low speed.

Additionally, as shown in FIG. 8, in connection with the range between the neutral center position N and the reverse throttle (R) fully closed position, all the combinations of lever positions result in the neutral drive of all the engines 6 of the starboard side outboard motor 5R, the port side outboard motor 5L and the middle outboard motor 5M, except for the combination that brings in the extremely low speed movement. Under those conditions, the watercraft 1 is at a standstill.

Figure 9:
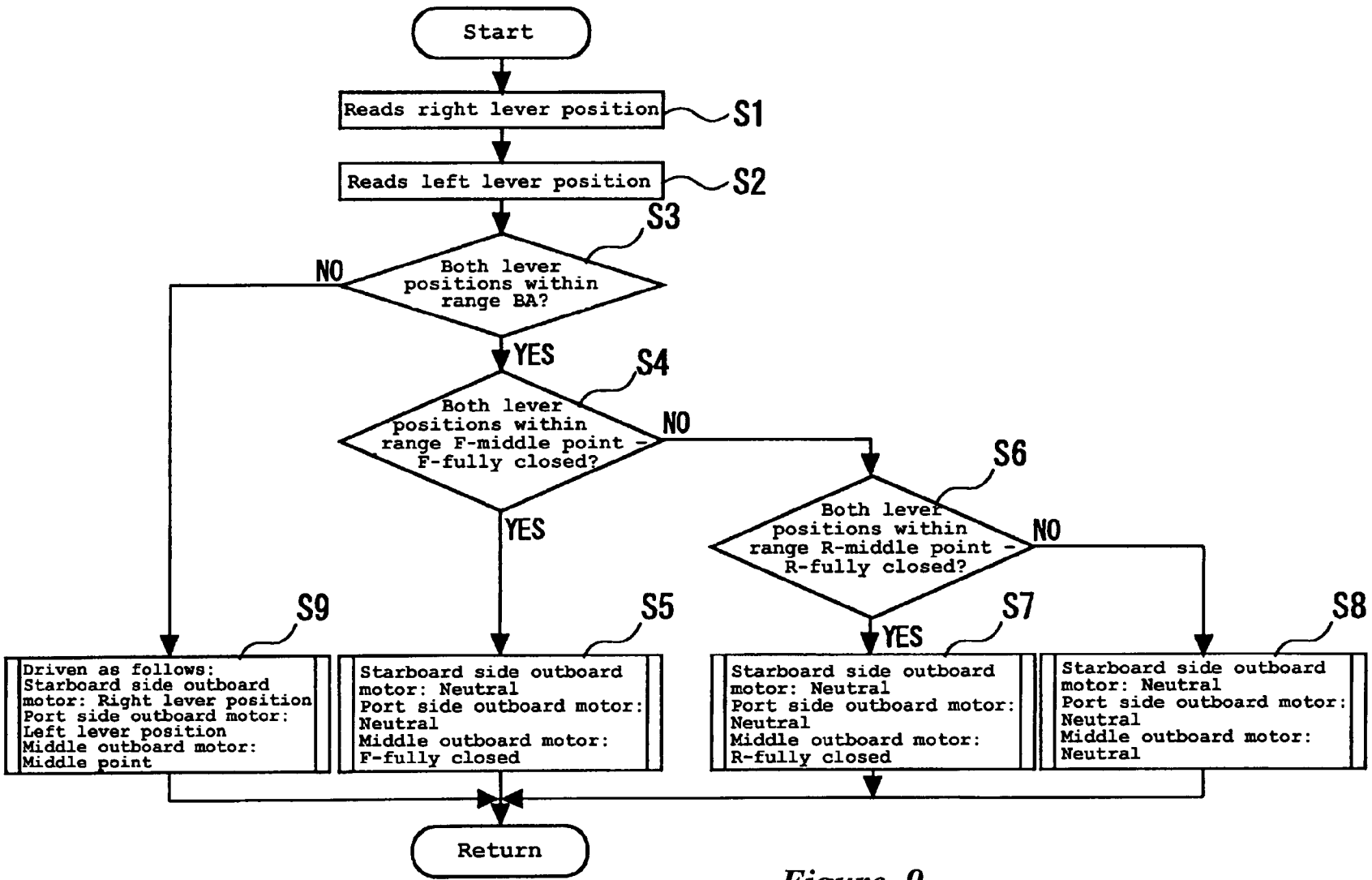
FIG. 9 is a flowchart illustrating a control method that can be used in conjunction with the control device.

FIG. 9 is a flowchart illustrating a control routine that can be used in conjunction with the control circuit 17 to conduct the operations of the outboard motors described above. A control program can be stored in a memory device (not shown) of the control circuit 17, and is, for example, a control routine executed every preset time. In some embodiments, the control circuit 17 can be in the form of a hard-wired feedback control circuit. Alternatively, the control circuit 17 can be constructed of a dedicated processor and a memory for storing a computer program configured to perform the steps S1-S9. Additionally, the control circuit 17 can be constructed of a general purpose computer having a general purpose processor and the memory for storing the computer program for performing the control routine shown in FIG. 9.

In Step S1, the computing section 17*a* can read a position of the right remote control lever 14R. In Step S2, the computing section 17*a* can read a position of the left remote control lever 14L.

In Step S3, the computing section 17*a* can determine whether or not both of the levers 14R, 14L are positioned within the neutral range BA (see FIG. 2). If the levers 14R, 14L are positioned within the neutral range BA (Yes), the computing section 17*a* goes to a step S4. Otherwise (No), the computing section 17*a* goes to a step S9.

In the Step S4, the computing section 17*a* determines whether or not both of the levers 14R, 14L are positioned in the range between the F side middle point and the F shift-in fully closed position (see FIG. 2). If the levers 14R, 14L are positioned within this range (Yes), the computing section 17*a* goes to a step S5. Otherwise (No), the computing section 17*a* goes to a step S6.

In the Step S5, the computing section 17*a* sets both shift mechanisms 19 of the starboard side outboard motor 5R and the port side outboard motor 5L to the neutral position, and drives the engine 6 of the middle outboard motor 5M as if the hypothetical remote control lever 14M for the outboard motor 5M is placed in the F shift-in fully closed position.

In the Step S6, the computing section 17*a* determines whether or not both of the levers 14R, 14L are positioned in the range between the R side middle point and the R shift-in fully closed position (see FIG. 2). If those are positioned within this range (Yes), the computing section 17*a* goes to a step S7. Otherwise (No), the computing section 17*a* goes to a step S8.

In the Step S7, the computing section 17*a* sets both of the shift mechanisms 19 of the starboard side outboard motor 5R and the port side outboard motor 5L to the neutral position, and drives the engine 6 of the middle outboard motor 5M as if the hypothetic remote control lever 14M for the outboard motor 5M is placed in the R shift-in fully closed position.

In Step 8, the computing section 17*a* sets all the shift mechanisms 19 of the starboard side outboard motor 5R, the port side outboard motor 5L and the middle outboard motor 5M to the neutral position.

In Step 9, the computing section 17*a* drives the shift mechanism 19 and the engine 6 of the starboard side outboard motor 5R in accordance with the position of the right remote control lever 14R, and also drives the shift mechanism 19 and the engine 6 of the port side outboard motor 5L in accordance with the position of the left remote control lever 14L. The computing section 17*a* further drives the shift mechanism 19 and the engine 6 of the middle outboard motor 5M in accordance with a center position defined by and between the right and left remote control levers 14R, 14L in the controller 13.

As thus described, in this embodiment, the control circuit 17 reads the positions of the right and left remote control levers 14R, 14L. The control circuit 17 sets the starboard side outboard motor 5R and the port side outboard motor 5L to the neutral mode, and drives the engine 6 of the middle outboard motor 5M as if the hypothetic shift lever for this motor 5R is in the F shift-in fully closed position, when both of the levers 14R, 14L are positioned in the range between the F side middle point and the F shift-in fully closed position of FIG. 2.

Also, the control circuit sets the starboard side outboard motor 5R and the port side outboard motor 5L to the neutral mode, and drives the engine 6 of the middle outboard motor 5M as if the hypothetic shift lever for this motor 5R is in the R shift-in fully closed position, when both of the levers are positioned in the range between the R side middle point and the R shift-in fully closed position of FIG. 2. Thereby, the operator can move the watercraft 1 forward or backward at the extremely low speed corresponding to the minimum thrust thereof by just operating the remote control levers. The trolling control, which is the control under which a watercraft moves at the extremely low speed, is thus practicable.

In some embodiments, the watercraft 1 has the three outboard motors. Alternatively, the watercraft 1 can have four or more outboard motors. If the watercraft 1 has four outboard motors, engines of two outboard motors located between the starboard side outboard motor and the port side outboard motor are driven as if the hypothetic shift levers for those motors are in the F shift-in fully closed position or in the R shift-in fully closed position, when both of the actual levers are positioned in the range between the F side middle point and the F shift-in fully closed position or between the R side middle point and the R shift-in fully closed position of FIG. 2.

Also, the condition regarding the lever positions under which the middle outboard motor operates is not limited to that the levers are positioned in the range between the F side middle point and the F shift-in fully closed position (or the range between the R side middle point and the R shift-in fully closed position), which is the condition applied in the embodiment described above. For example, the range can be larger in consideration of the operability. The range can also be defined within the neutral range BA.

As usage other than watercrafts, vehicles (for example, hovercrafts) having a plurality of engines juxtaposed with each other can also benefit from the inventions disclosed herein. Shift and throttle operations of those vehicles can be made similarly by two control levers without giving a feeling of wrongness to the operator.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A control method for a watercraft that has three or more outboard motors mounted thereon in a side-by-side arrangement, at least two control levers configured to allow an operator to control gear shift and power output adjustments of two of the outboard motors located on the outer-most sides and configured to also control gear shift and power output adjustments of all the outboard motors, wherein each of the control levers include a forward range, a reverse range, and a neutral range between the forward and reverse ranges, the method comprising setting a shift position of an outboard motor located between the outer-most outboard motors at a forward position or a reverse position, and setting a throttle opening of the outboard motor located between the outer-most outboard motors at a preset opening when both of the control levers are placed at a preset position in the respective neutral ranges.

2. The control method for a watercraft according to claim 1, wherein the neutral range is a range defined by and between a forward shift-in operation start position that shares a border with the forward range and a reverse shift-in operation start position that shares a border with the reverse range, wherein a condition that a center of the neutral range is defined as a neutral center position and a central position between the neutral center position and the forward shift-in operation start position is defined as a forward side middle position, the preset position of the respective neutral ranges exists between the forward side middle position and the forward shift-in operation start position.

3. The control method for a watercraft according to claim 1, wherein the neutral range is a range defined by and between a forward shift-in operation start position that shares a border with the forward range and a reverse shift-in operation start position that shares a border with the reverse range, wherein a center of the neutral range is defined as a neutral center position and a central position between the neutral center position and the reverse shift-in operation start position is defined as a reverse side middle position, the preset position of the respective neutral ranges exists between the reverse side middle position and the reverse shift-in operation start position.

4. A control device for a watercraft that has three or more outboard motors mounted on a transom thereof side by side with each other, a controller including two control levers configured to allow an operator to input gear shift and engine power output commands to two of the outboard motors, respectively, located on the outer-most sides of the watercraft, and a detection device configured to detect respective control positions of the two levers, the control device comprising a control circuit configured to compute gear shift positions and power output settings of all the outboard motors based upon the respective control positions of the two levers, the control circuit including a computing section configured to change the gear position of one of the outboard motors interposed between the two outer-most outboard motors to a forward position or a reverse position and to change a power output setting of said one of the outboard motors to a minimum power output setting, when both detected positions of the two levers are consistent with preset positions within their respective neutral ranges.

5. The control device according to claim 4, wherein the power output settings correspond to throttle opening positions of throttle valves disposed in each of the outboard motors.

6. A control system for a watercraft having at least first, second, and third outboard motors, the third outboard motor being disposed between the first and second outboard motors, the control system comprising at least first and second input devices configured to allow an operator of the watercraft to input gear change commands corresponding to gear positions of the outboard motors and power output commands corresponding to power outputs of the outboard motors, the first and second input devices including neutral ranges corresponding to neutral gear positions of the first and second outboard motors, wherein the control system is configured so as to maintain the gear positions of the first and second outboard motors in the neutral position and to change the gear position of the third outboard motor to a forward or reverse gear position when the first and second levers are moved within the neutral ranges toward boundaries between the neutral ranges and forward or reverse gear position ranges.

* * * * *

UNITED STATES PATENT AND TRADEMARK OFFICE

CERTIFICATE OF CORRECTION

PATENT NO. : 7,220,153 B2
APPLICATION NO. : 11/182678
DATED : May 22, 2007
INVENTOR(S) : Takashi Okuyama It is certified that error appears in the above-identified patent and that said Letters Patent is hereby corrected as shown below:

At column 5, line 59, please delete "sift" and insert -- shift --, therefor.

At column 6, line 16, please delete "is" and insert -- in --, therefor.

Signed and Sealed this

Twenty-ninth Day of July, 2008

JON W. DUDAS
*Director of the United States Patent and Trademark Office*